US008913092B2

(12) United States Patent
Ha et al.

(10) Patent No.: US 8,913,092 B2
(45) Date of Patent: Dec. 16, 2014

(54) COMPENSATION TABLE GENERATING SYSTEM, DISPLAY APPARATUS HAVING BRIGHTNESS COMPENSATION TABLE, AND METHOD OF GENERATING COMPENSATION TABLE

(75) Inventors: Youngsuk Ha, Uiwang-si (KR); Jee-Hoon Jeon, Hwaseong-si (KR); Min-Kyu Park, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 254 days.

(21) Appl. No.: 13/368,704

(22) Filed: Feb. 8, 2012

(65) Prior Publication Data

US 2012/0206504 A1 Aug. 16, 2012

(30) Foreign Application Priority Data

Feb. 14, 2011 (KR) ..... 10-2011-0012954

(51) Int. Cl.
*G09G 5/10* (2006.01)

(52) U.S. Cl.
CPC ..... *G09G 5/10* (2013.01)
USPC ..... 345/690; 345/691; 345/214

(58) Field of Classification Search
CPC ..... G09G 5/10
See application file for complete search history.

(56) References Cited

U.S. PATENT DOCUMENTS

2006/0061593 A1* 3/2006 Miura et al. ..... 345/612
2008/0049051 A1* 2/2008 Han et al. ..... 345/690
2008/0238936 A1* 10/2008 Kim ..... 345/618

FOREIGN PATENT DOCUMENTS

JP 2002108298 A 4/2002
JP 2006-211052 A 8/2006
JP 2009-271501 A 11/2009
JP 2010-057149 A 3/2010

* cited by examiner

*Primary Examiner* — Joe H Cheng
*Assistant Examiner* — Lisa Landis
(74) *Attorney, Agent, or Firm* — Cantor Colburn LLP

(57) ABSTRACT

A compensation table generating system includes a test signal applying part which applies a test signal corresponding to reference gray scales to a display panel, an image obtaining part which obtains a test image of each of the reference gray scales displayed on the display panel based on the test signal, a position information extractor which measures a brightness distribution of each of the reference gray scales of the display panel based on the test image of each of the reference gray scales and extracts a representative position information of an stain area, in which a stain appears, based on the brightness distribution of each of the reference gray scales, a compensation data calculator which calculates a compensation data corresponding to a position of the stain area, and a brightness compensation table which stores the representative position information and the compensation data.

8 Claims, 8 Drawing Sheets

COMPENSATION TABLE GENERATING SYSTEM, DISPLAY APPARATUS HAVING BRIGHTNESS COMPENSATION TABLE, AND METHOD OF GENERATING COMPENSATION TABLE

This application claims priority to Korean Patent Application No. 10-2011-0012954 filed on Feb. 14, 2011, and all the benefits accruing therefrom under 35 U.S.C. §119, the content of which in its entirety is herein incorporated by reference.

BACKGROUND OF THE INVENTION

1. Field of Disclosure

Exemplary embodiments of the invention relate to a compensation table generating system to prevent waste of a display panel, a display apparatus having a brightness compensation table, and a method of generating the compensation table.

2. Description of the Related Art

In general, a liquid crystal display panel is manufactured by a semiconductor process with a photolithography process. The photolithography process includes various processes, such as an exposure process, a development process and an etch process, for example. During the photolithography process, a brightness stain may appear on the display panel due to non-uniform light exposure.

In detail, non-uniformity in an overlapping area between a gate electrode and a drain electrode of a thin film transistor, a height of a spacer, a parasitic capacitance between signal wires, a parasitic capacitance difference between a pixel electrode and the signal wires during the photolithography process by the irregular light exposure may cause non-uniform brightness on the display panel of the liquid crystal display panel, thereby causing the brightness stain in a linear shape or dot shape.

Although liquid crystal panels with the brightness stain may be treated by a repair process, most of the liquid crystal display panels with the brightness stain have been wasted.

BRIEF SUMMARY OF THE INVENTION

Exemplary embodiments of the invention provide a compensation table generating system that prevents waste of a display panel.

Exemplary embodiments of the invention provide a display apparatus employing the brightness compensation table.

Exemplary embodiments of the invention provide a method of generating a compensation table with reduced size.

According to an exemplary embodiment, a compensation table generating system includes a test signal applying part which applies a test signal corresponding to a plurality of reference gray scales to a display panel, an image obtaining part which obtains a test image of each of the plurality of reference gray scales displayed on the display panel based on the test signal, a position information extractor which measures a brightness distribution of each of the plurality of reference gray scales of the display panel based on the test image of each of the plurality of reference gray scales and extracts a representative position information of an stain area, in which a stain appears, based on the brightness distribution of each of the plurality of reference gray scales, a compensation data calculator which calculates a compensation data corresponding to a position of the stain area, and a brightness compensation table which stores the representative position information and the compensation data.

According to another exemplary embodiment, a display apparatus includes a display panel which displays an image corresponding to an image signal, a brightness compensation table which stores a representative position information corresponding to a stain area, in which a stain appears, on the display panel and compensation data corresponding to positions in the stain area, and a display panel driver which receives the image signal, compensates for a portion of the image signal corresponding to the stain area based on the brightness compensation table to generate a compensation signal, applies the compensation signal to the stain area of the display panel, and applies a remaining portion of the image signal to a remaining area, except for the stain area, of the display panel, where the representative position information comprises a portion of the position information of the stain area on the display panel.

According to another exemplary embodiment, a method of generating a compensation table includes applying a test signal corresponding to a plurality of predetermined reference gray scales to a display panel, obtaining a test image of each of the plurality of reference gray scales displayed on the display panel, measuring a brightness distribution of each of the plurality of reference gray scales based on the obtained test image, and extracting a representative position information of a stain area, in which a stain appears, based on the brightness distribution of each of the plurality of reference gray scale, calculating a compensation data corresponding to a position in the stain area, and storing the representative position information and the compensation data to generate a brightness compensation table.

In an exemplary embodiment, the representative position information of the stain area is extracted and stored in the brightness compensation table when the brightness compensation table is generated, and the entire size of the brightness compensation table is thereby substantially reduced.

BRIEF DESCRIPTION OF THE DRAWINGS

The above and other features and aspects of the invention will become readily apparent by describing in detailed exemplary embodiments thereof with reference to the accompanying drawings, in which.

DETAILED DESCRIPTION OF THE INVENTION

Figure 1:
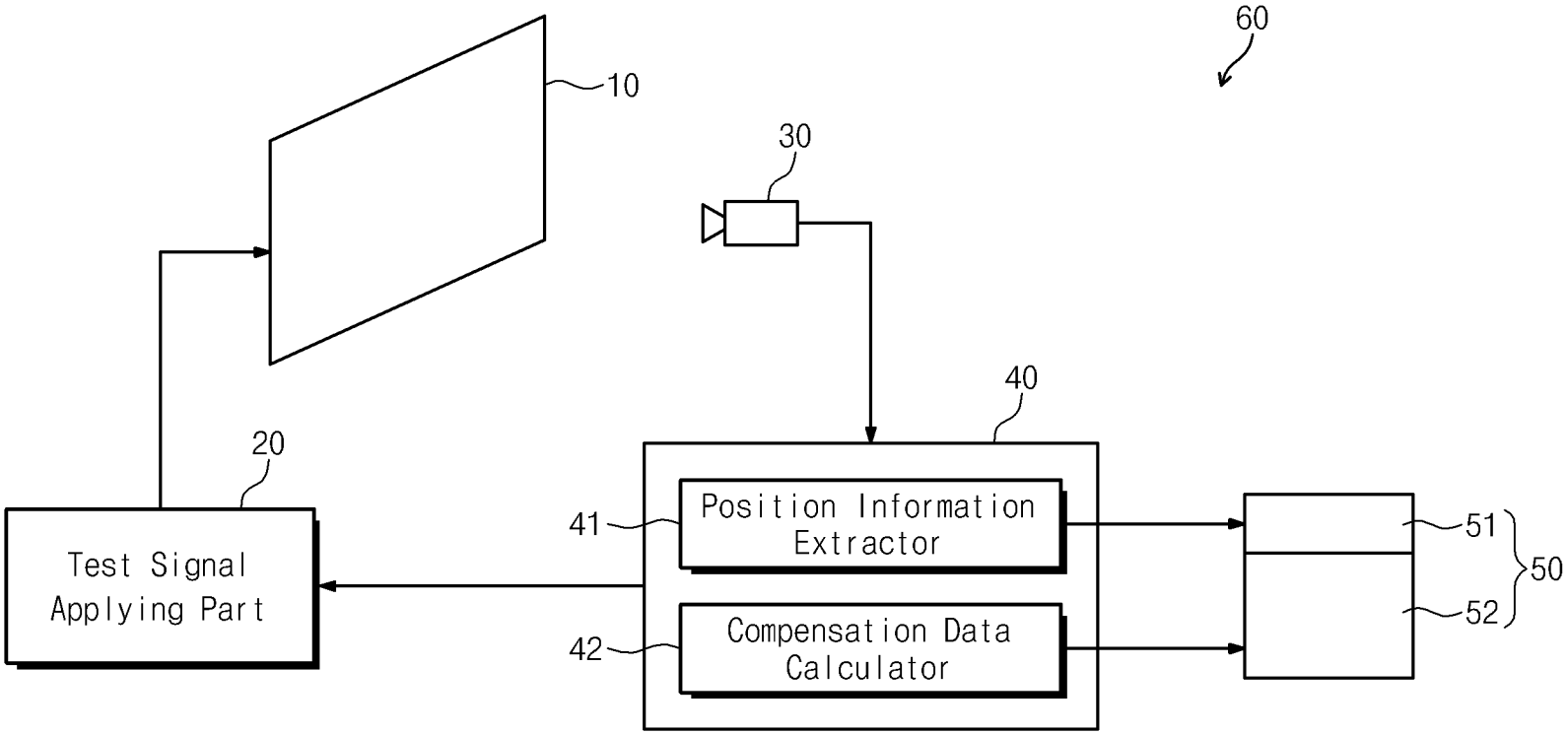
FIG. 1 is a block diagram showing an exemplary embodiment of a compensation table generating system according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein Hereinafter, exemplary embodiments of the invention will be explained in detail with reference to the accompanying drawings.

Figure 2:
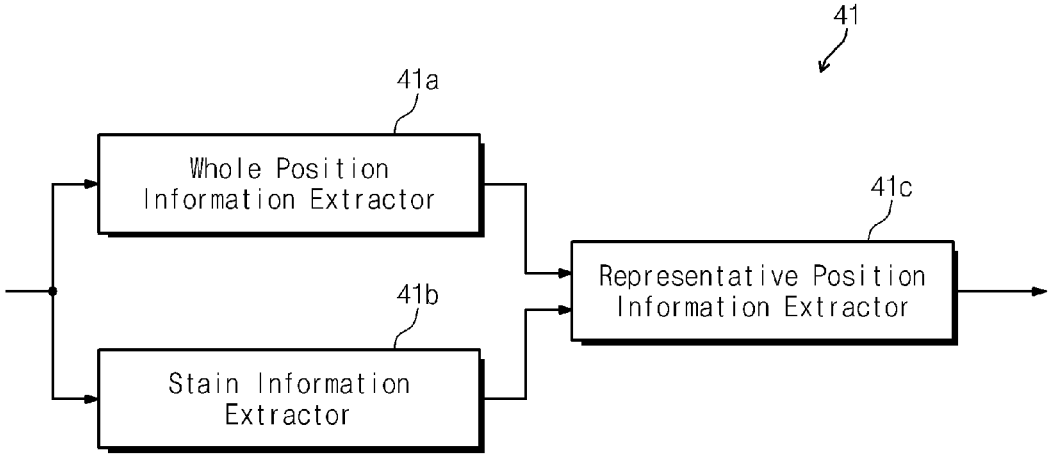
FIG. 2 is a block diagram showing an exemplary embodiment of a position information extractor shown in FIG. 1.

FIG. 1 is a block diagram showing an exemplary embodiment of a compensation table generating system according to the invention, and FIG. 2 is a block diagram showing an exemplary embodiment of a position information extractor shown in FIG. 1.

Referring to FIG. 1, a compensation table generating system 60 includes a test signal applying part 20, an image obtaining part 30, a brightness controlling part 40, and a brightness compensation table 50. The compensation table generating system 60 is used to generate the brightness compensation table 50 to control stains shown in predetermined gray scales.

In such an embodiment, the test signal applying part 20 is operated based on instructions from the brightness controlling part 40, and applies a test signal of each of the predetermined gray scales (e.g., reference gray scales) to the liquid crystal display panel 10. In one exemplary embodiment, for example, the test signal may include 8-bit data, and the test signal applying part 20 applies the test signal of each of the reference gray scale selected from 256 gray scales to the liquid crystal display panel 10 while changing the reference gray scales on a scale-by-scale basis.

The liquid crystal display panel 10 displays a test image for each of the reference gray scales in response to the test signal.

The image obtaining part 30 obtains the test image for each of the reference gray scales, which is displayed on the liquid crystal display panel 10. The image obtaining part 30 includes a device to take the test image displayed on the liquid crystal display panel 10, e.g., a camera, and provide the obtained test image to the brightness controlling part 40. In one exemplary embodiment, the image obtaining part 30 may be a charged-coupled device ("CCD") camera.

The brightness controlling part 40 measures a brightness distribution corresponding to each of the reference gray scales of the liquid crystal display panel 10 based on the test image for each of the reference gray scales. The brightness controlling part 40 includes a position information extractor 41 and a compensation data calculator 42. The position information extractor 41 generates stain information regarding a size and shape of the stain appeared on the liquid crystal display panel 10 based on the brightness distribution of each of the reference gray scales, and extracts representative position information of an area in which the stain appears based on the stain information.

Referring to FIG. 2, the position information extractor 41 includes a whole position information extractor 41*a*, a stain information extractor 41*b*, and a representative position information extractor 41*c*.

The whole position information extractor 41*a* extracts whole position information of areas in which the stain appears based on the brightness distribution of each of the reference gray scales. The stain information extractor 41*b* generates the stain information regarding the size and shape of the stain appeared on the liquid crystal display panel 10 based on the brightness distribution of each of the reference gray scales.

The representative position information extractor 41*c* may extract the representative position information from the whole position information based on the stain information. The extracted representative position information may be stored in the brightness compensation table 50.

Referring to again to FIG. 1, the compensation data calculator 42 calculates compensation data according to positions of areas in which the stain appears based on the brightness distribution of each gray scale. The process of calculating the compensation data will be described in detail with reference to FIG. 4 below.

The brightness compensation table 50 stores the representative position information and the compensation data output from the brightness controlling part 40 therein. As an example, the brightness compensation table 50 may include a first storing area 51 in which the representative position information is stored and a second storing area 52 in which the compensation data is stored. In such an embodiment, the brightness compensation table 50 may be a type of non-volatile memory, e.g., electrically erasable programmable read-only memory ("EEPROM").

Figure 3:
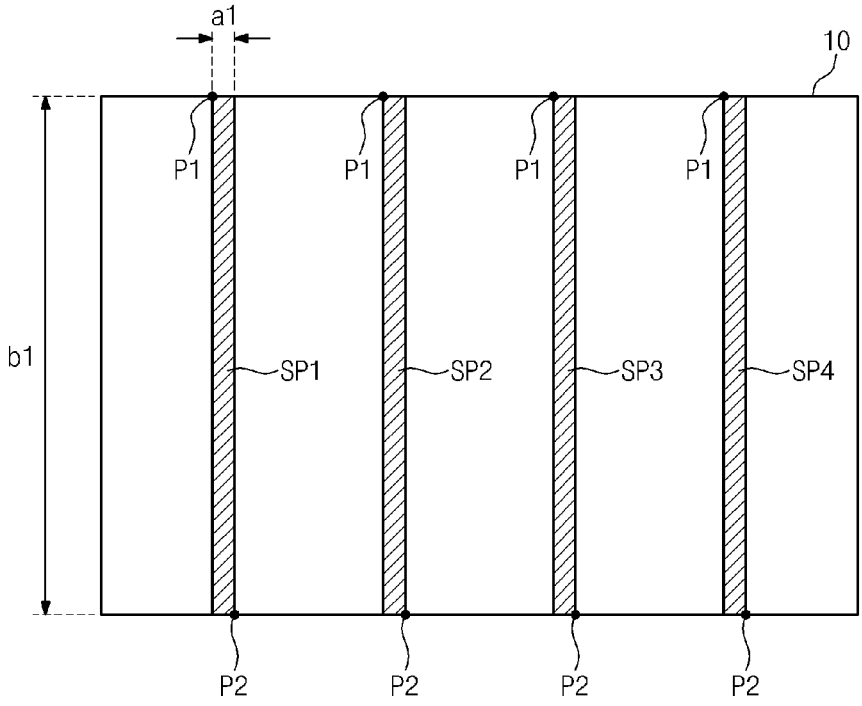
FIG. 3 is a plan view showing stains appeared on an exemplary embodiment of a liquid crystal display panel.

FIG. 3 is a plan view showing stains appeared on an exemplary embodiment of a liquid crystal display panel. FIG. 3 shows brightness stains vertically appeared on the liquid crystal display panel 10 by applying the test signal corresponding to a predetermined gray scale to the liquid crystal display panel 10.

Referring to FIG. 3, first, second, third, and fourth stain areas SP1, SP2, SP3 and SP4 are appeared on the liquid crystal display panel 10, and each of the first, second, third, and fourth stain areas SP1, SP2, SP3 and SP4 has relatively higher brightness than other areas when a test signal corresponding to the same gray scale is applied. Each of the first to fourth stain areas SP1 to SP4 may have the same size and shape or different sizes and shapes. In FIG. 3, an exemplary embodiment, in which the first to fourth stain areas SP1 to SP4 have the same size and shape, is shown.

In such an embodiment, the first stain area SP1 has a rectangular shape having a first width a1 and a first length b1, and the first width a1 and the first length b1 may be included in the stain information. In such an embodiment, the shape of the first stain area SP1 may be included in the stain information after being transformed to data.

In an exemplary embodiment, the representative position information of the first stain area SP1 may include coordinate values of a start point P1 and an end point P2 of the first stain area SP1. When the coordinate values of the start point P1 and the end point P2 of the first stain area SP1 and the stain information of the first stain area SP1, such as the width, length and shape of the first stain area SP1, are obtained, the whole position information of the first stain area SP1 may be obtained.

In an exemplary embodiment, the stain area have a definite shape and the stain information includes only the coordinate values of the start and end points of the stain area, and the whole position information of the stain area may be obtained. In such an embodiment, the representative position information of each of the first to fourth stain areas SP1 to SP4 may include only the coordinate values of the start point SP1 and the end point SP2 of each stain area.

In such an embodiment, the brightness compensation table 50 may not store coordinate values related to the whole position of each of the first to fourth stain areas SP1 to SP4. That is, the brightness compensation table 50 stores the representative position information including only the start point P1 and the end point P2 of each of the first to fourth stain areas SP1 to SP4 and sequentially stores compensation data corresponding to the whole position of each of the first to fourth stain areas SP1 to SP4.

In one exemplary embodiment, for example, the coordinate value (540 line, 1 line) of the start point and the coordinate value (550 line, 1920 line) of the end point may be stored in the first storing area 51 as the representative position information, and the whole compensation data of each stain area, e.g., −0.75 gray, −1.0 gray, −1.25 gray, for example, may be sequentially stored in the second storing area 52.

In an exemplary embodiment, the brightness compensation table 50 may further include a third storing area (not shown) in which the stain information is stored.

Figure 4:
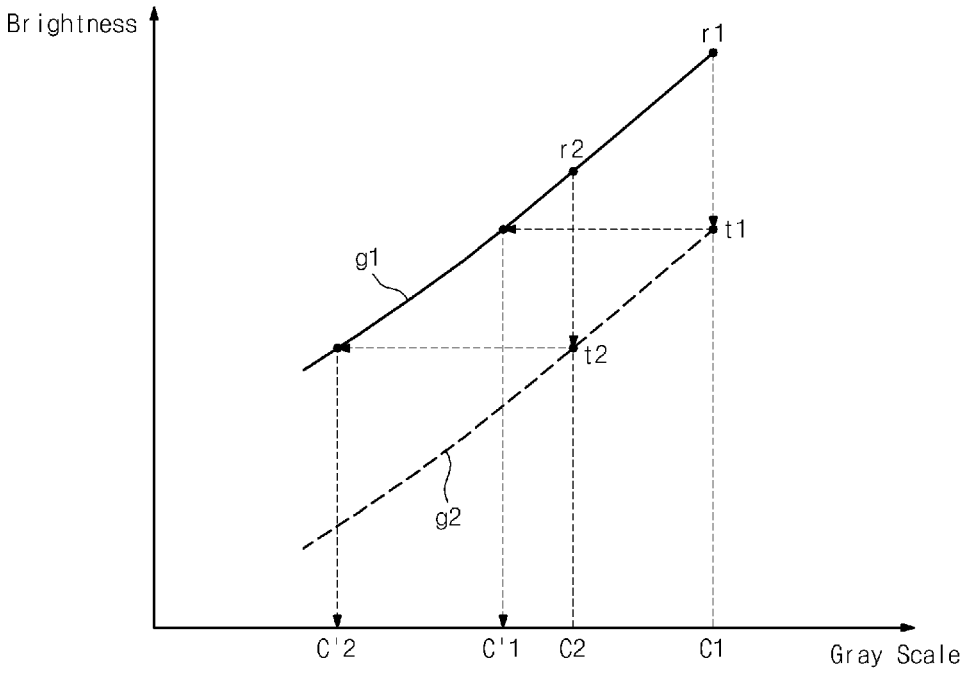
FIG. 4 is a graph showing brightness versus gray scale of gamma curves used in a process of calculating compensation data.

FIG. 4 is a graph showing brightness versus gray scale of gamma curves used in a process of calculating compensation data. In FIG. 4, a first graph g1 indicates a stain gamma curve, and a second graph g2 indicates a normal gamma curve. In FIG. 4, an x-axis indicates the gray scale and a y-axis indicates the brightness.

Referring to FIG. 4, the stain gamma curve g1 has the brightness higher than the brightness of the normal gamma curve g2 with respect to a same gray scale. A shown in FIG. 4, the stain gamma curve g1 has a first brightness r1 at a first gray scale C1 and a second brightness r2 at a second gray scale C2.

The normal gamma curve g2 has a third brightness t1 lower than the first brightness r1 at the first gray scale C1 and a fourth brightness t2 lower than the second brightness r2 at the second gray scale C2.

In an exemplary embodiment, the compensation data calculator 42 extracts the gray scale value having the third brightness t1 from the stain gamma curve g1 to compensate for the first brightness r1 of the stain gamma curve g1 to the third brightness t1. That is, the stain gamma curve g1 has the third brightness t1 at a third gray scale C'1. Thus, the compensation data calculator 42 extracts the third gray scale C'1 as a compensation gray scale value of the first gray scale C1 and extracts a difference value between the first gray scale C1 and the third gray scale C'1 as the compensation data of the first gray scale C1.

In such an embodiment, a gray scale value having the fourth brightness t2 is extracted from the stain gamma curve g1 to control the second brightness r2 of the stain gamma curve g1 to the fourth brightness t2, that is, the stain gamma curve g1 has the fourth brightness t2 at a fourth gray scale C'2. Accordingly, the compensation data calculator 42 extracts the fourth gray scale C'2 as a compensation gray scale value of the second gray scale C2 and extracts a difference value between the fourth gray scale C'2 and the second gray scale C2 as the compensation data of the second gray scale C2.

In an exemplary embodiment, the compensation data calculator 42 may generate the compensation data of each of the reference gray scales.

In an exemplary embodiment, the compensation data calculator 42 may further include a dithering processor (not shown). The dithering processor applies a dithering method to represent a gray scale less than a unit gray scale when a compensation gray scale values are extracted by corresponding the first and second gray scales r1 and r2 to the normal gamma curve g2.

Figure 5:
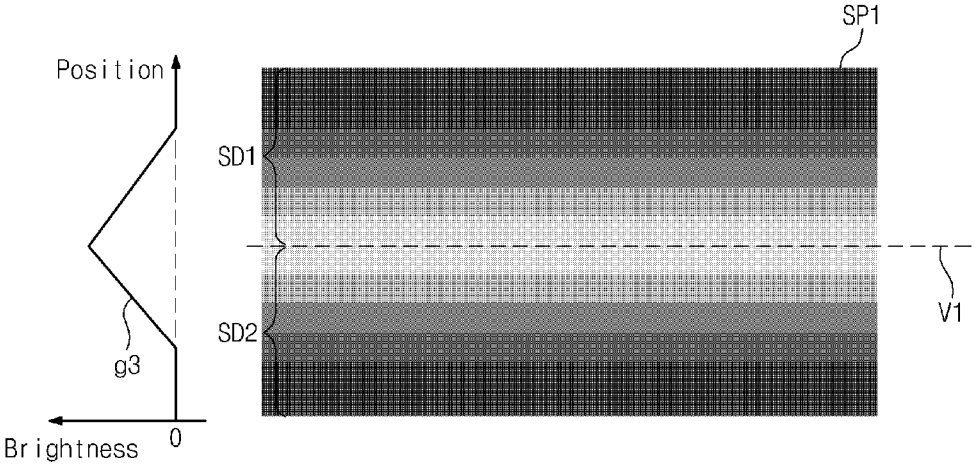
FIG. 5 is a plan view showing a brightness distribution of a first stain area on another exemplary embodiment of a liquid crystal display panel.

FIG. 5 is a plan view showing a brightness distribution of a first stain area in another exemplary embodiment of a liquid crystal display panel. In FIG. 5, a third graph g3 shows brightness variation with respect to the position of the first stain area.

Referring to FIG. 5, the first stain area SP1 may be divided into a first sub-area SD1 and a second sub-area SD2 with reference to an imaginary line V1 that divides the first stain area SP1 into two equal parts. Each of the first and second sub-areas SD1 and SD2 may have a brightness that decreases from the imaginary line V1.

As represented by the third graph g3, the brightness distribution of the first sub-area SD1 and the brightness distribution of the second sub-area SD2 may be symmetric to each other with respect to the imaginary line V1.

In such an embodiment, the brightness controlling part 40 shown in FIG. 1 checks whether the brightness distribution of the first sub-area SD1 and the brightness distribution of the second sub-area SD2 are symmetric or not with respect to the imaginary line V1. When the brightness distribution of the first sub-area SD1 and the brightness distribution of the second sub-area SD2 are symmetric to each other, the compensation data of one of the first and second sub-areas SD1 and SD2 may be generated. In such an embodiment, where each stain area includes two sub-areas SD1 and SD2 symmetric to each other with respect to the imaginary line V1, the brightness compensation table 50 may store the compensation data of one of the first and second sub-areas SD1 and SD2, and the size of the brightness compensation table 50 may be reduced by half since the brightness compensation table 50 stores the compensation data of only one of the first and second sub-areas.

The brightness controlling part 40 checks whether the brightness distribution of the first sub-area SD1 and the brightness distribution of the second sub-area SD2 in each of the first to fourth stain areas SP2 to SP4 are symmetric to each other with respect to a imaginary line therein. When the brightness distribution of the first sub-area SD1 and the brightness distribution of the second sub-area SD2 in each of the first to fourth stain areas SP2 to SP4 are symmetric to each other, the compensation data of only one of the first and second sub-areas SD1 and SD2 may be generated and stored in the brightness compensation table 50.

Figure 6:
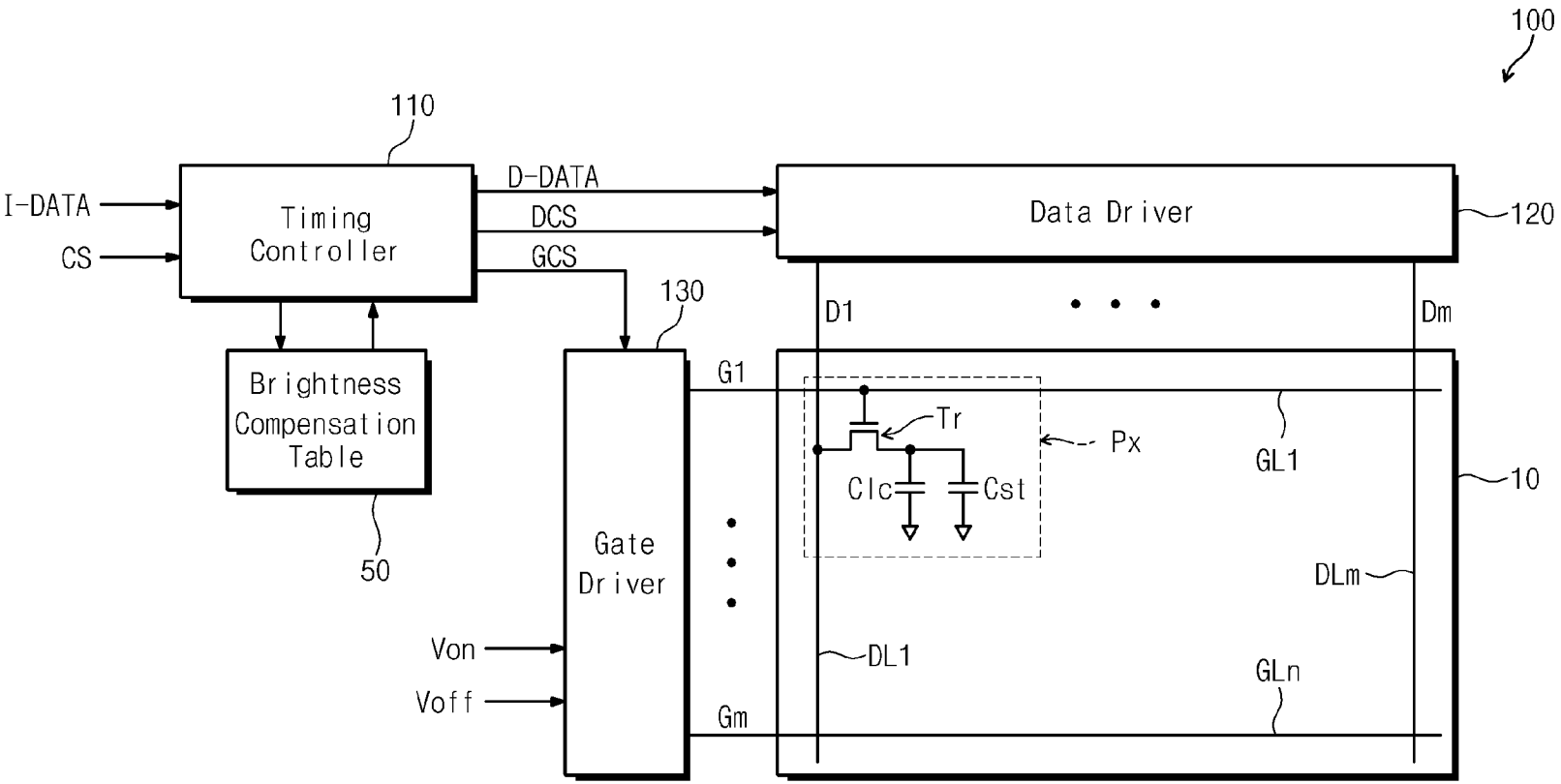
FIG. 6 is a block diagram showing an exemplary embodiment of a display apparatus according to f the invention.
Figure 7:
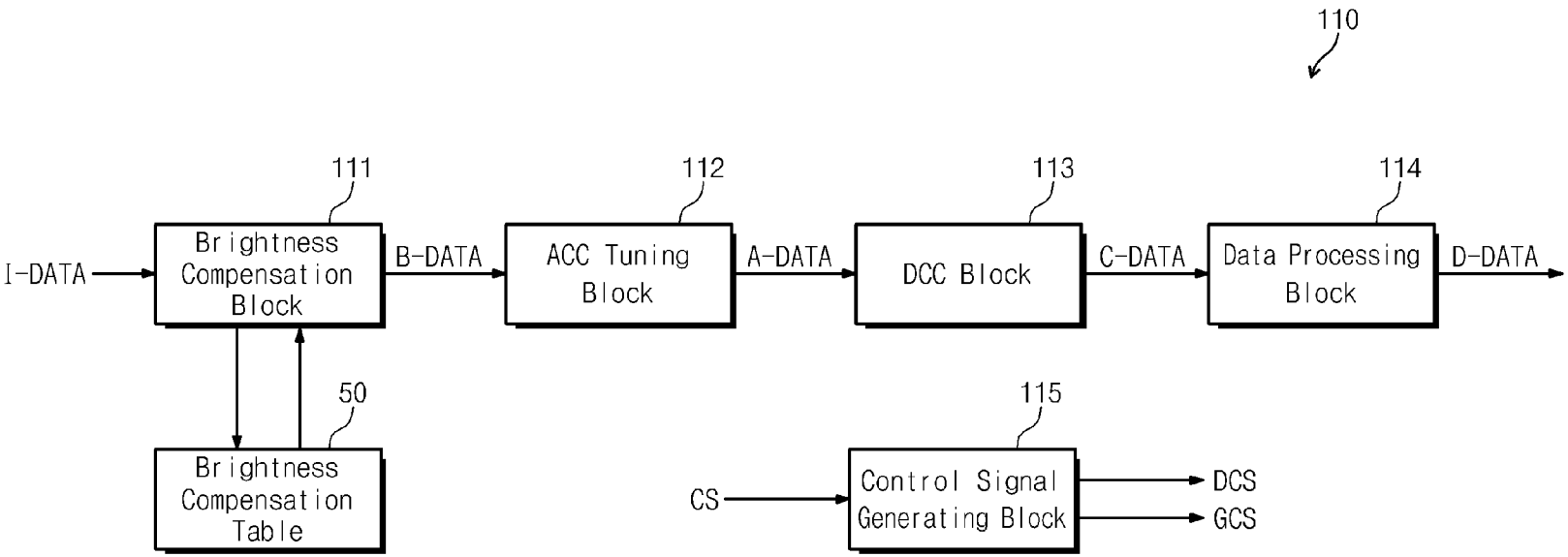
FIG. 7 is a block diagram showing an exemplary embodiment of a timing controller shown in FIG. 6.

FIG. 6 is a block diagram showing an exemplary embodiment of a display apparatus according to the invention, and FIG. 7 is a block diagram showing an exemplary embodiment of a timing controller shown in FIG. 6.

Referring to FIG. 6, a display apparatus 100 includes a timing controller 110, a brightness compensation table 50, a data driver 120, a gate driver 130 and a liquid crystal display panel 10.

The timing controller 110 receives a control signal CS and an input image signal I-DATA from an external device. The input image signal I-DATA may include red, green and blue image signals.

As shown in FIG. 7, the timing controller 110 includes a brightness compensation block 111, an accurate color capture ("AAC") tuning block 112, a dynamic capacitance capture ("DCC") block 113, a data processing block 114 and a control signal generating block 115.

The brightness compensation block 111 receives the input image data I-DATA and compensates for image data to be applied to the area, in which a stain appears on the liquid crystal display panel 10, among the input image data I-DATA based on the compensation data stored in the brightness compensation table 50.

In such an embodiment, when the stain in a specific area has a brightness relative higher than a brightness in other areas, the brightness compensation block 111 compensates for the brightness in the specific area using a gray scale lower than an input gray scale based on the compensation data. When the stain in the specific area have a brightness relatively lower than a brightness in the other areas, the brightness compensation block 111 compensates for the brightness in the specific area using a gray scale higher than the input gray scale based on the compensation data.

In an exemplary embodiment, the brightness compensation block 111 outputs a first compensated image data B-DATA. The first compensation image data B-DATA is applied to the ACC tuning block 112.

The ACC tuning block 112 performs a gamma compensation for the first compensated image data B-DATA based on a compensation gamma value, which is predetermined based on gamma characteristics of the display apparatus 100, and outputs a second compensated image data A-DATA. In such an embodiment, the red, green and blue gamma characteristics may be different from each other in the display apparatus 100, and the display apparatus 100 may display brightnesses different from each other with respect to the red, green and blue image data having a same gray scale (brightness variation). In one exemplary embodiment, for example, the brightness of the blue image data having the same gray scale is represented at the highest value, the brightness of the red image data having the same gray scale is represented at the lowest value, and the brightness of the green image data having the same gray scale is represented at the intermediate value between the brightness of the blue image data and the brightness of the red image data.

The ACC tuning block 112 sets a reference gamma characteristic (e.g., 2.2 gammas) and sets the compensation gamma value based on differences with respect to the reference gamma characteristic and the gray scale of each of the red, green and blue gamma characteristics to compensate for the brightness variation. Thus, the ACC tuning block 112 adds the compensation gamma value to the red, green, and blue image data or subtracts the compensation gamma value from the red, green, and blue image data to compensate for the brightness variation (hereinafter, the compensation process for the brightness variation is referred to as "ACC tuning process").

The ACC tuning block 112 may expand the number of bits of the first compensation image data B-DATA to compensate for the gamma value. That is, when the number of bits of the first compensated image data B-DATA is M bits, the ACC tuning block 112 may expand the number of bits of the first compensated image data B-DATA to (M+d) bits.

Accordingly, the ACC tuning block 112 may perform the ACC tuning using the first compensated image data B-DATA having the expanded number of bits, and the ACC tuning block 112 may generate a second compensated image data A-DATA through the ACC tuning process.

In an exemplary embodiment, the ACC tuning block 112 may contract the number of bits (M+d) of the second compensated image data A-DATA to the M bits such that the second compensation image data A-DATA is processed by the data driver 120. The second compensation image data A-DATA output from the ACC tuning bock 112 may be applied to the DCC block 113.

In an exemplary embodiment, the DCC block 113 compensates for the gray scale value of the second compensated image data A-DATA based on a predetermined DCC compensation value according to the gray scale difference between the second compensated image data A-DATA of a current frame and a compensation image data of a previous frame to improve a response speed of the present frame. In such an embodiment, the DCC block 113 enhances the gray scale value of the second compensated image data A-DATA above a target gray scale value (hereinafter, this process of enhancing the gray scale value of the second compensation image data A-DATA above the target gray scale value is referred to as "DCC compensation process").

In an exemplary embodiment, for the DCC compensation process, the timing controller 110 may further includes a DCC lookup table, in which DCC compensation values are stored.

The DC block 113 outputs a third compensated image data C-DATA using the DCC compensation process. The third compensated image data C-DATA is applied to the data processing block 114.

The data processing block 114 changes a data format of the third compensated image data C-DATA generated by the DCC block 113 to apply a fourth compensated image data D-DATA to the data driver 120.

The control signal generating block 115 generates a data control signal DCS and a gate control signal GCS on the basis of the control signal CS provided from the external device. The control signal CS may include various signals, such as a vertical synchronization signal, a horizontal synchronization signal, a main clock signal and a data enable signal, for example.

Referring again to FIG. 6, the data control signal DCS is applied to the data driver 120 to control the driving of the data driver 120. The data control signal DCS may include various signals, such as a horizontal start signal to start the driving of the data driver 120, an inverting signal to invert a polarity of a data voltage, and an output indicating signal to determine an output timing of the data voltage from the data driver 120, for example.

The gate control signal GCS is applied to the gate driver 130 to control the driving of the gate driver 120. The gate control signal GCS may include various signals, such as a vertical start signal to start the driving of the gate driver 130, a gate clock signal to determine an output timing of the gate pulse, and an output enable signal to decide a pulse width of the gate pulse, for example.

The data driver 120 receives red, green and blue data RDn', GDn' and BDn' in synchronization with the data control signal DCS from the timing controller 110. The data driver 120 receives gamma reference voltages generated by a gamma reference voltage generator (not shown) and converts the red, green and blue data RDn', GDn' and BDn' into data voltages D1 to Dm based on the gamma reference voltages.

The gate driver 130 receives a gate-on voltage Von and a gate-off voltage Voff generated by a voltage generator (not shown) and sequentially outputs gate signals G1 to Gn, which are swing between the gate-on voltage Von and the gate-off voltage Voff, in synchronization with the gate control signal GCS from the timing controller 110.

The liquid crystal display panel 10 includes a plurality of data lines DL1 to DLm that receives the data voltages from the data driver 120, a plurality of gate lines GL1 to GLn that sequentially receives the gate signals from the gate driver 130, and a plurality of pixels PX. Each of the pixels PX includes a thin film transistor Tr, a liquid crystal capacitor Clc and a storage capacitor Cst. The thin film transistor Tr includes a source electrode connected to a corresponding data line of the data lines DL1 to DLm, a gate electrode connected to a corresponding gate line of the gate lines GL1 to GLn, and a drain electrode connected to the liquid crystal capacitor.

Each of the pixels PX receives the data voltage applied to the corresponding data line in response to the gate signal applied to the corresponding gate line. The data voltage is charged in the liquid crystal capacitor and a light transmittance of a liquid crystal layer (not shown) is controlled by the level of the charged voltage, and thus the liquid crystal display panel 10 may display desired images.

Figure 8:
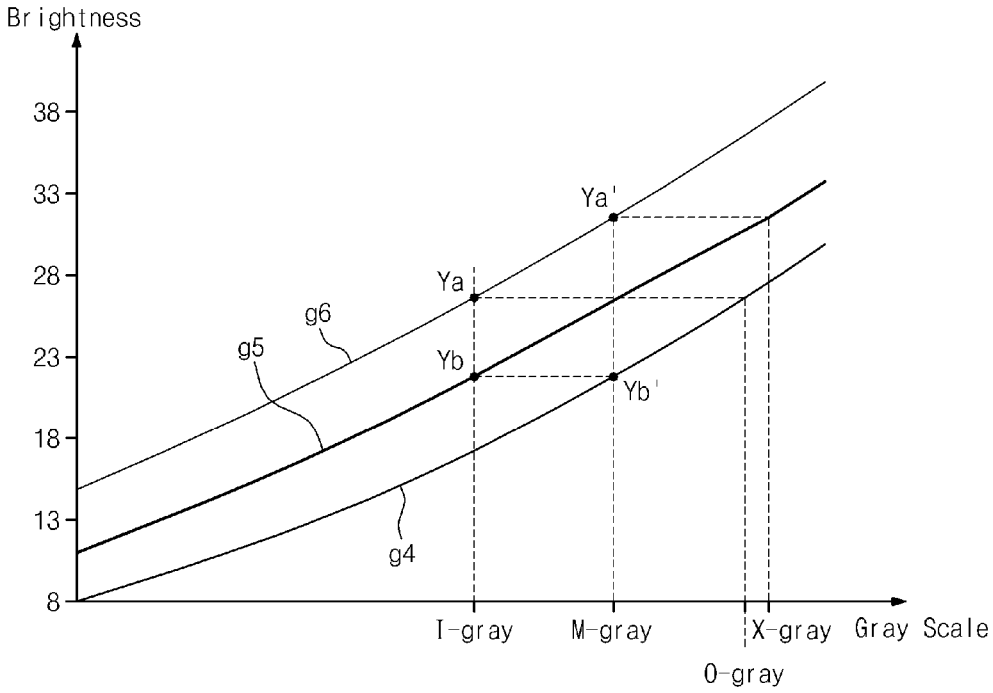
FIG. 8 is a graph showing brightness versus gray scale of gamma curves used in a process of processing data in a timing controller shown in FIG. 7.

FIG. 8 is a graph showing brightness versus gray scale of gamma curves used in a process of processing data in the timing controller shown in FIG. 7. In FIG. 8, a fourth graph g4 indicates a stain gamma curve, a fifth graph g5 indicates a normal gamma curve before performing the ACC tuning process, and a sixth graph g6 indicates the normal gamma curve after performing the ACC tuning process. In FIG. 8, an x-axis indicates the gray scale and a y-axis indicates the brightness.

Referring to FIG. 8, the stain gamma curve g4 has a first brightness Yb at a first input gray scale I-gray. In an exemplary embodiment where a process of compensating a brightness stain is performed to compensate for the first brightness Yb using the normal gamma curve g5, the first input gray scale I-gray is converted to a first compensation gray scale M-gray having a second brightness Y'b.

When performing the ACC tuning process for the first compensation gray scale M-gray using the normal gamma curve g6, the first compensation gray scale M-gray is converted to a second compensation gray scale X-gray having a third brightness Y' a.

When performing the ACC tuning process for the first input gray scale I-gray using the normal gamma curve g6 without performing the brightness stain compensation process, the first input gray scale I-gray is converted to a third compensation gray scale O-gray having a fourth brightness Ya.

As shown in FIG. 8, since the difference between the second compensation gray scale X-gray and the third compensation gray scale O-gray is not substantially large in value, the ACC compensation value when the brightness stain compensation process is performed in the ACC tuning process may be substantially the same as the ACC compensation value when the brightness stain compensation process is omitted in the ACC tuning process.

As described above, the brightness stain appeared on the liquid crystal display panel 10 may be effectively prevented or substantially reduced through the brightness compensation processing method, and the waste of the liquid crystal display panel 10 are effectively prevented.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A compensation table generating system comprising:

a test signal applying part which applies a test signal corresponding to a plurality of reference gray scales to a display panel;

an image obtaining part which obtains a test image of each of the plurality of reference gray scales displayed on the display panel based on the test signal;

a position information extractor which measures a brightness distribution of each of the plurality of reference gray scales of the display panel based on the test image of each of the plurality of reference gray scales and extracts a representative position information of an stain area, in which a stain appears, based on the brightness distribution of each of the plurality of reference gray scales;

a compensation data calculator which calculates a compensation data corresponding to a position of the stain area; and a brightness compensation table which stores the representative position information and the compensation data, wherein the position information extractor extracts a stain information including a size and a shape of the stain area and outputs a coordinate value of a start point and a coordinate value of an end point of the stain area based on the stain information as the representative position information, the stain area is divided into a first sub area and a second sub area with reference to a predetermined reference line when the brightness distribution of the first sub area and the brightness distribution of the second sub area are symmetric to each other with respect to the reference line, and the compensation table calculator generates the compensation data corresponding to the first sub area or the second sub area.

2. The compensation table generating system of claim 1, wherein the brightness compensation table comprises:

a first storing area in which the coordinate value of the start point and the coordinate value of the end point are stored; and a second storing area in which the compensation data are sequentially stored.

3. The compensation table generating system of claim 1, wherein the brightness compensation table comprises:

a first storing area which the representative position information is stored; and a second storing area in which the compensation data with respect to the first sub area or the second sub area is stored.

4. The compensation table generating system of claim 1, wherein the compensation data calculator extracts a reference brightness value corresponding to a first input gray scale from a stain gamma curve with respect to the stain area, extracts a second input gray scale corresponding to the reference brightness value from a predetermined normal gamma curve, and obtains the compensation data of the first input gray scale based on a difference between the second input gray scale and the first input gray scale.

5. A display apparatus comprising:

a display panel which displays an image corresponding to an image signal;

a brightness compensation table which stores a representative position information corresponding to a stain area, in which a stain appears, on the display panel and compensation data corresponding to positions in the stain area; and a display panel driver which receives the image signal, compensates for a portion of the image signal corresponding to the stain area based on the brightness compensation table to generate a compensation signal, applies the compensation signal to the stain area of the display panel, and applies a remaining portion of the image signal to a remaining area, except for the stain area, of the display panel, wherein the representative position information comprises a portion of the position information of the stain area on the display panel, and wherein the representative position information comprises:

a coordinate value of a start point of the stain area; and a coordinate value of an end point of the stain area, and where in the stain area is divided into a first sub area and a second sub area with reference to a predetermined reference line when the brightness distribution of the first sub area and the brightness distribution of the second sub area are symmetric to each other with respect to the reference line, and a second storing area stores the compensation data corresponding to the first sub area or the second sub area.

6. The display apparatus of claim 5, wherein the brightness compensation table comprises:

a first storing area in which the representative position information is stored; and a second storing area in which the compensation data corresponding to the positions are sequentially stored.

7. A method of generating a compensation table, the method comprising:

applying a test signal corresponding to a plurality of predetermined reference gray scales to a display panel;

obtaining a test image of each of the plurality of reference gray scales displayed on the display panel;

measuring a brightness distribution of each of the plurality of reference gray scales based on the obtained test image, and extracting a representative position information of a stain area, in which a stain appears, based on the brightness distribution of each of the plurality of reference gray scale;

calculating a compensation data corresponding to a position in the stain area; and storing the representative position information and the compensation data to generate a brightness compensation table, wherein the extracting the representative position information comprises:

extracting a stain information including a size information of the stain area and a shape information of the stain area; and extracting the representative position information including a coordinate value of a start point and a coordinate value of an end point of the stain area based on the stain information, and wherein the calculating the compensation data comprises:

determining whether the stain area includes a first sub area and a second sub area, which have brightness distributions symmetric to each other with respect to a predetermined reference line; and calculating the compensation data corresponding to one of the first sub area and the second sub area when the brightness distribution of the first sub area and the brightness distribution of the second sub area are symmetric to each other with respect to the predetermined reference line.

8. The method of claim 7, wherein the calculating the compensation data comprises:

extracting a reference brightness value corresponding to a first input gray scale from a gamma curve with respect to the stain area;

extracting a second input gray scale corresponding to a reference brightness value from a predetermined normal gamma curve; and obtaining the compensation data of the first input gray scale based on a difference value between the second input gray scale and the first input gray scale.

* * * * *